US006322421B1

(12) United States Patent
Hou

(10) Patent No.: US 6,322,421 B1
(45) Date of Patent: Nov. 27, 2001

(54) TOY STRUCTURE OF LUMINOUS DOLL TYPE

(76) Inventor: Chin-Jung Hou, 58, Ma Yuan West St., Taichung (TW)

( * ) Notice: Subject to any disclaimer, the term of this patent is extended or adjusted under 35 U.S.C. 154(b) by 0 days.

(21) Appl. No.: 09/546,151

(22) Filed: Apr. 5, 2000

(51) Int. Cl.[7] ..... A63H 33/26
(52) U.S. Cl. ..... 446/485; 446/219; 446/330
(58) Field of Search ..... 446/485, 219, 446/330, 352, 353, 354, 358; 40/410, 411, 412, 413, 414, 415

(56) References Cited

U.S. PATENT DOCUMENTS

| | | | | |
|---|---|---|---|---|
| 2,724,926 | * | 11/1955 | Fisher | 446/353 |
| 3,223,412 | * | 12/1965 | Freeman et al. | 446/405 |
| 5,247,753 | * | 9/1993 | Yang | 40/414 |
| 5,277,644 | * | 1/1994 | Osborne et al. | 446/219 |
| 5,545,069 | * | 8/1996 | Glynn et al. | 446/73 |
| 5,588,895 | * | 12/1996 | Larson | 446/98 |
| 5,683,164 | * | 11/1997 | Chien | 446/439 |
| 5,816,883 | * | 10/1998 | Holland | 446/219 |
| 6,012,820 | * | 1/2001 | Weber et al. | 446/485 |
| 6,082,876 | * | 7/2000 | Hanson et al. | 446/485 |
| 6,171,170 | * | 1/2001 | Lin | 446/404 |
| 6,174,072 | * | 1/2001 | Root, Jr. | 362/190 |
| 6,180,193 | * | 1/2001 | Bostedt | 428/7 |

* cited by examiner

*Primary Examiner*—Kien T. Nguyen
*Assistant Examiner*—Faye Francis

(57) ABSTRACT

A luminous toy structure includes a lower casing mounted on a base, an upper casing secured on the lower casing and including a rotatable drive rod and two fixed support rods, a support hood for securing the base, the lower casing and the upper casing together, a support disk secured on the two support rods, a swing device having an eccentric wheel secured on the drive rod to rotate therewith, an eccentric rod secured on the eccentric wheel, two arm skeletons each having a pivot shaft pivotally mounted on the support disk, a follower defining an oblong slot receiving the eccentric rod for pivoting the pivot shaft, and an extension bar pivoted with the pivot shaft, a first pivot tube having a first gear, a follower defining an oblong slot receiving the eccentric rod, a second pivot tube having a second gear meshing with the first gear, and two wing bars each secured to one of the first pivot tube and the second pivot tube to pivot therewith.

11 Claims, 11 Drawing Sheets

TOY STRUCTURE OF LUMINOUS DOLL TYPE

BACKGROUND OF THE INVENTION

1. Field of the Invention

The present invention relates to an improved toy structure, and more particularly to an improved toy structure of a luminous angel-shaped doll.

2. Description of the Related Art

A conventional toy of an angel-shaped doll is fixed and serious without variation of colors, and cannot enhance the true activity and mobility of its head, hands, and wings.

SUMMARY OF THE INVENTION

The present invention has arisen to mitigate and/or obviate the disadvantages of the conventional angel-shaped doll.

The primary object of the present invention is to provide a luminous doll-shaped toy structure which can be adapted to afford music, variation of colors, recreation activity, and can also enhance the true mobility of its head, hands, and wings.

In accordance with one aspect of the present invention, there is provided a luminous toy structure comprising a base; a lower casing mounted on the base; an upper casing secured on the lower casing and including a drive rod rotatably mounted thereon, and two support rods each secured thereon; a support hood mounted around the base, the lower casing and the upper casing for securing the base, the lower casing and the upper casing together; a support disk secured on the two support rods and defining a central hole for receiving the drive rod; a swing device mounted on the support disk and including: an eccentric wheel supported on the support disk and secured on the drive rod to rotate therewith, an eccentric rod secured on the eccentric wheel; a first arm skeleton including a first pivot shaft pivotally mounted on the support disk, a first follower secured on the first pivot shaft for pivoting the first pivot shaft and defining a first oblong slot for receiving the eccentric rod, and a first extension bar secured to the first pivot shaft to pivot therewith; a second arm skeleton including a second pivot shaft pivotally mounted on the support disk, a second follower secured on the second pivot shaft for pivoting the second pivot shaft and defining a second oblong slot for receiving the eccentric rod, and a second extension bar secured to the second pivot shaft to pivot therewith; a first pivot tube pivotally mounted on the support disk and including a third follower defining a third oblong slot for receiving the eccentric rod, and a first gear secured thereon; and a second pivot tube pivotally mounted on the support disk and including a second gear meshing with the first gear; and two wing bars each secured to one of the first pivot tube and the second pivot tube to pivot therewith.

Further benefits and advantages of the present invention will become apparent after a careful reading of the detailed description with appropriate reference to the accompanying drawings.

DETAILED DESCRIPTION OF THE INVENTION

Figure 1:
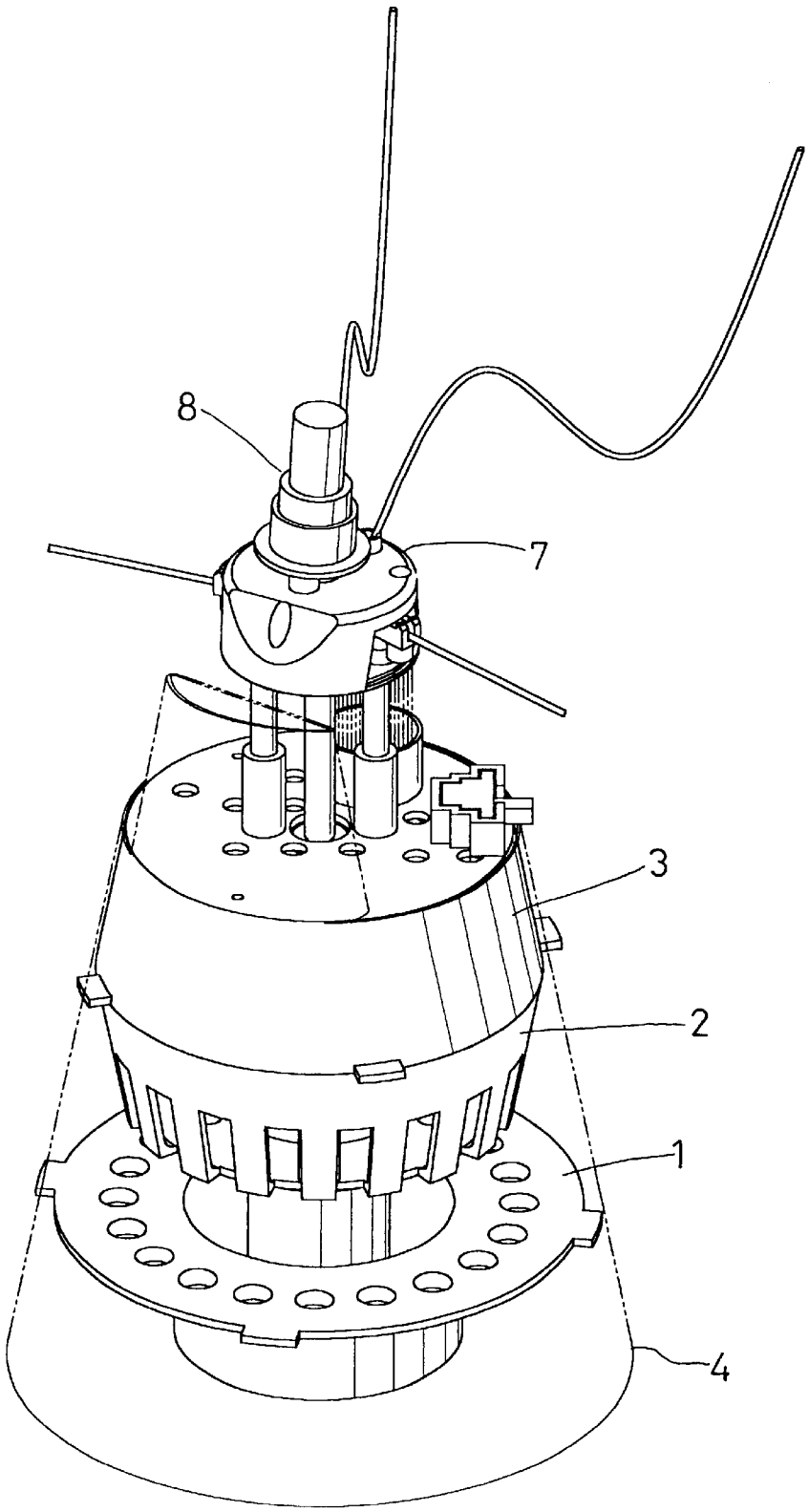
FIG. 1 is a perspective view of a toy structure of a luminous doll type in accordance with the present invention.
Figure 2:
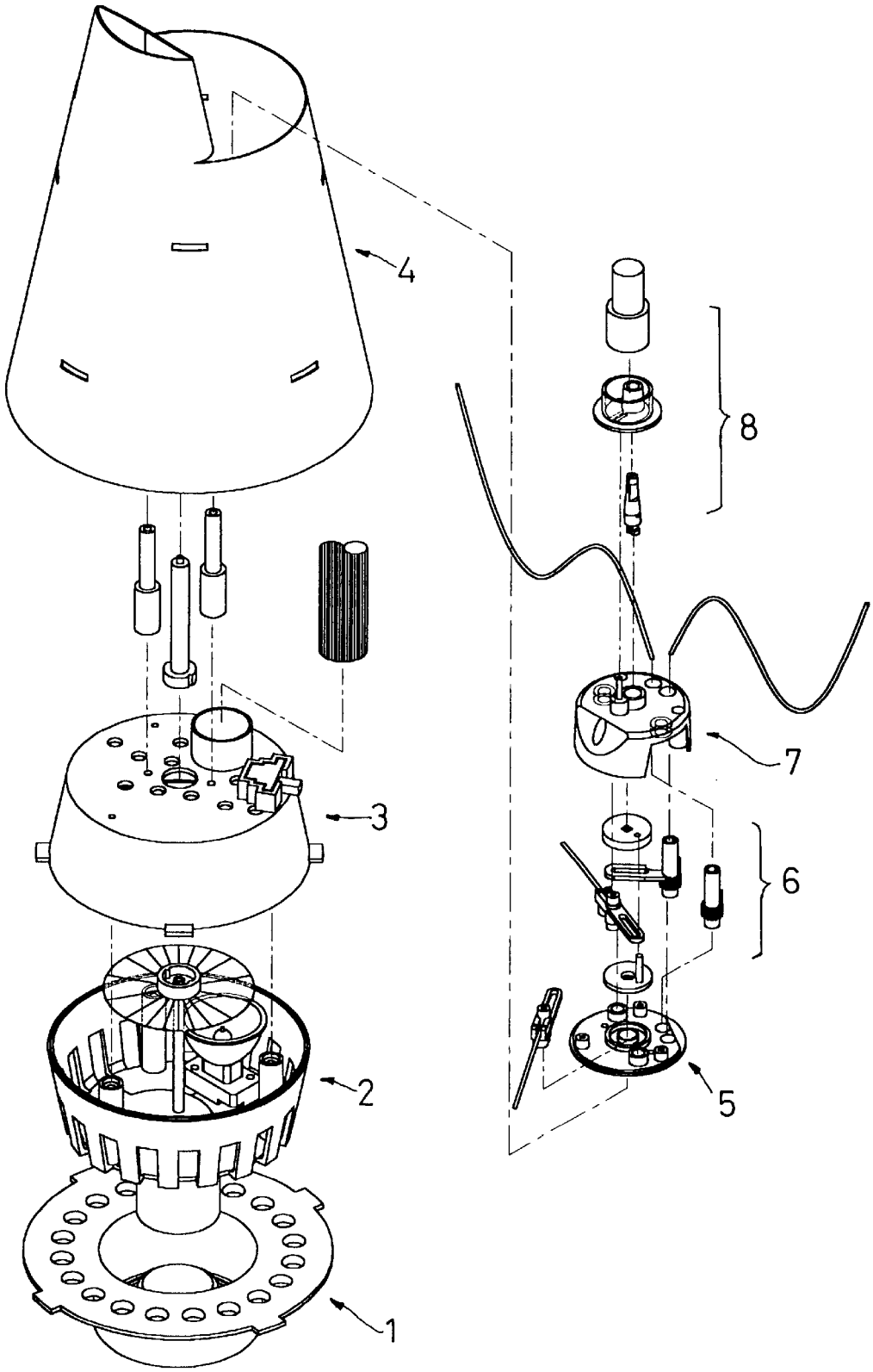
FIG. 2 is an exploded view of the toy structure as shown in FIG. 1.

Referring to the drawings and initially to FIGS. 1–7, a luminous toy structure of an angel-shaped doll in accordance with the present invention comprises a base 1, a lower casing 2, an upper casing 3, a support hood 4, a support disk 5, a swing device 6, a shoulder cover 7, and a head turning device 8.

The lower casing 2 is mounted on the base 1 and includes a plurality of first threaded posts 25. The upper casing 3 is secured on the lower casing 2 and includes a plurality of second threaded posts 31 (see FIG. 5) each engaged with a respective one of the first threaded posts 25 for securing the upper casing 3 to the lower casing 2. The upper casing 3 also includes a rotatable drive rod 36 secured in a rotating ring 233 of the lower casing 2 to rotate therewith, and two fixed support rods 37 secured on the upper casing 3.

The support hood 4 is mounted around the base 1, the lower casing 2 and the upper casing 3 for securing the base 1, the lower casing 2 and the upper casing 3 together. The support hood 4 defines a plurality of retaining holes 42, and has a top portion formed with a reduced section 41 defining an opening 411.

The base 1 defines a receiving chamber 12 and includes an annular flange 11 having a plurality of first tongues 111 protruding outward and each secured in a respective one of the retaining holes 42, and a speaker 13 mounted in the receiving chamber 12.

The tipper casing 3 defines a central hole 35 for passage of the drive rod 36 and includes a plurality of second tongues 32 protruding outward each secured in a respective one of the retaining holes 42, a switch 33 secured on the upper casing 3 for operating the motor 23 of the lower casing 2, a receiving tube 34 secured on the upper casing 3, and a bundle of optical fiber 341 mounted in the receiving tube 34.

Figure 3:
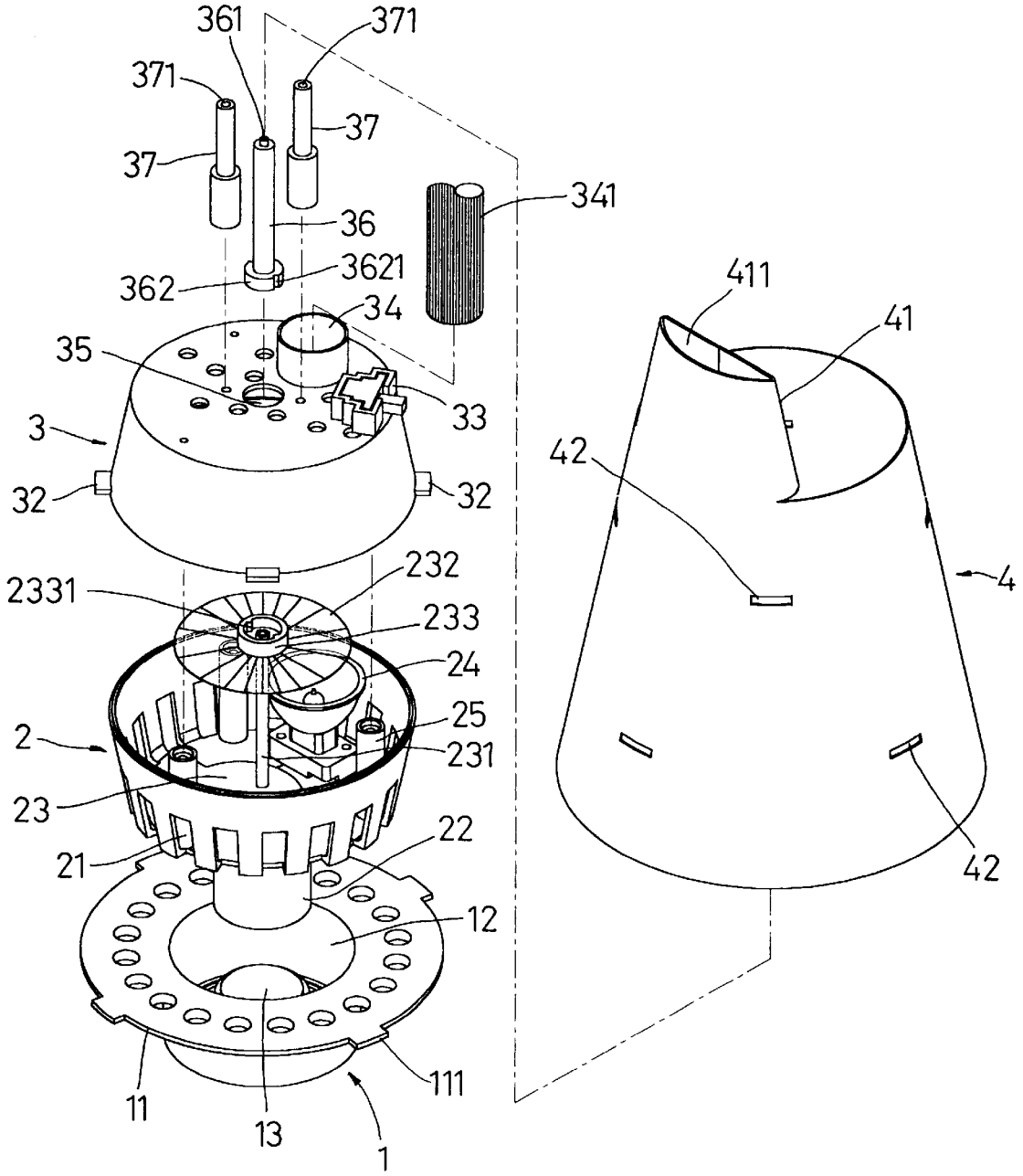
FIG. 3 is an exploded view of the toy structure as shown in FIG. 1.
Figure 4:
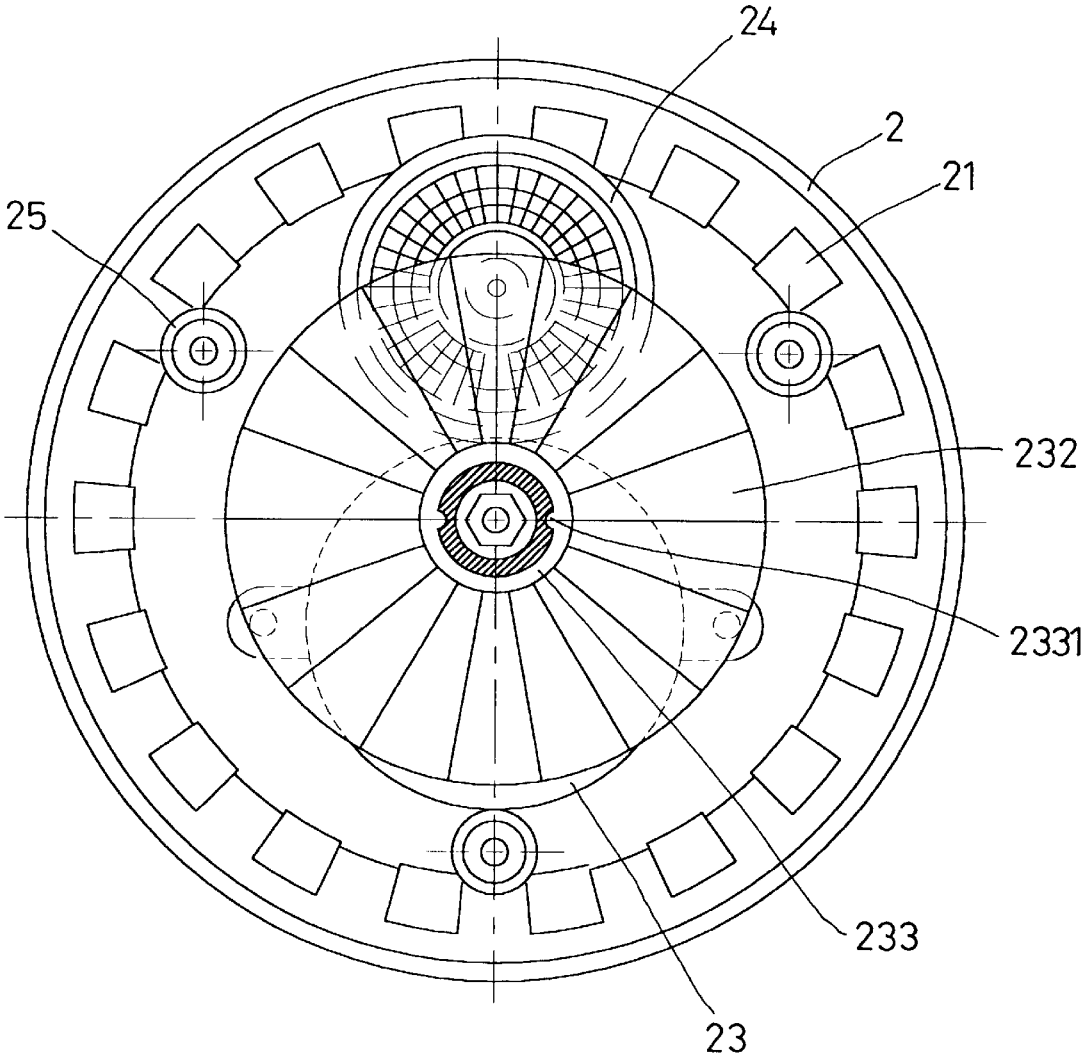
FIG. 4 is a top plan view of the toy structure as shown in FIG. 1.
Figure 5:
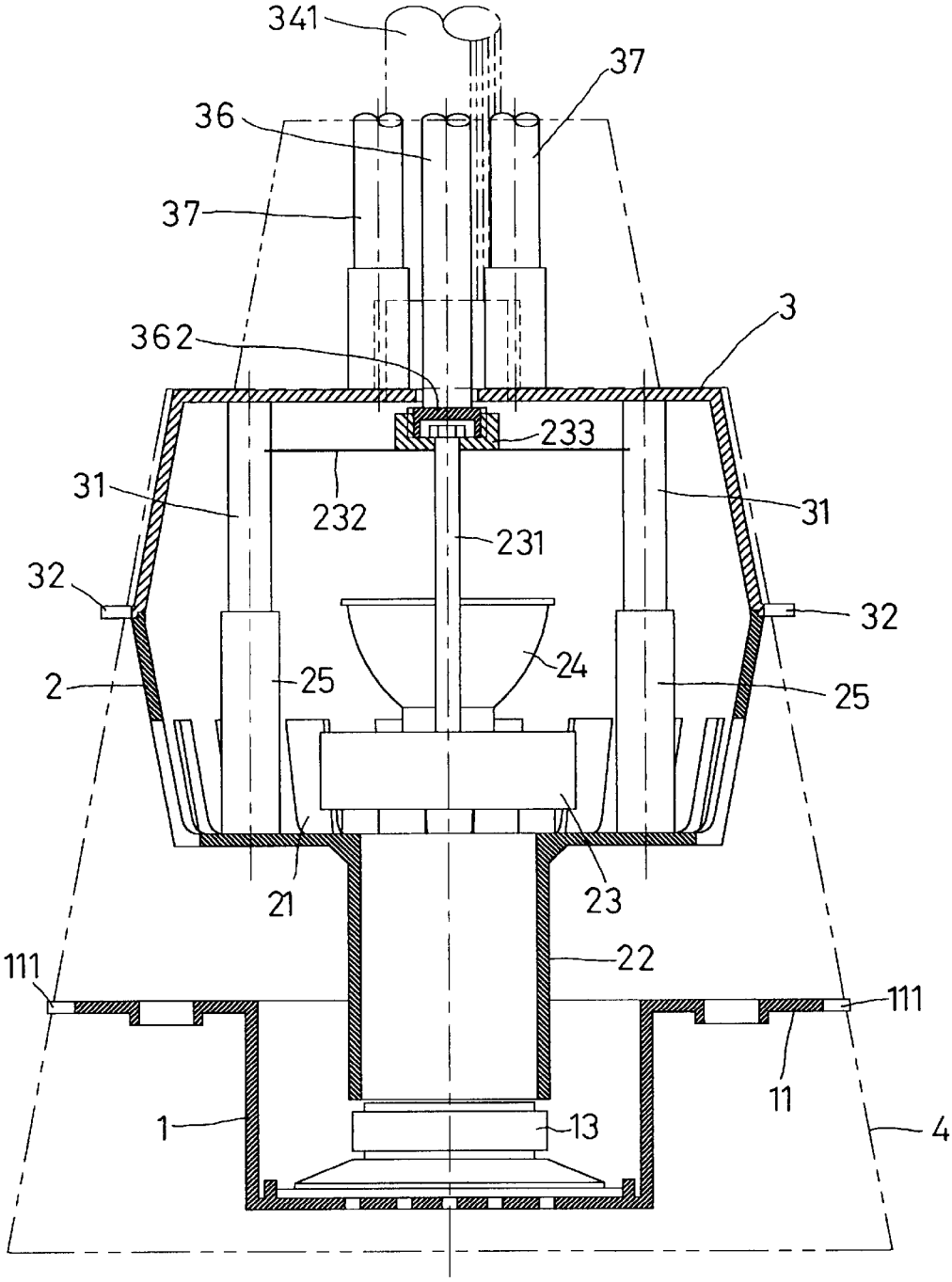
FIG. 5 is a front plan cross-sectional view of the toy structure as shown in FIG. 1.

As shown in FIG. 3, the lower casing 2 defines a plurality of heat radiating slots 21 and includes a hollow post 22 extending downward and abutting the speaker 13, a motor 23 mounted in the lower casing 2, an output shaft 231 having a lower end secured on the motor 23 to be rotated by the motor 23, a color disk 232 secured on an upper end of the output shaft 231 to rotate therewith, a rotating ring 233 secured on the color disk 232 to rotate therewith, a plurality of bosses 2331 mounted in the rotating ring 233, a projecting lamp 24 mounted in the lower casing 2 and directed toward the color disk 232 as shown in FIGS. 4 and 5 for emitting light to the color disk 232, thereby presenting various and diverse colors from the color disk 232.

The drive rod 36 has a lower end formed with a follower wheel 362 secured in the rotating ring 233 to rotate therewith and defining a plurality of dents 3621 each receiving a corresponding one of the bosses 2331.

By such an arrangement, the drive rod 36 is rotated by the rotating ring 233 which is rotated by the color disk 232 which is rotated by the output shaft 231 which is rotated by the motor 23 which is operated by the switch 33.

Figure 6:
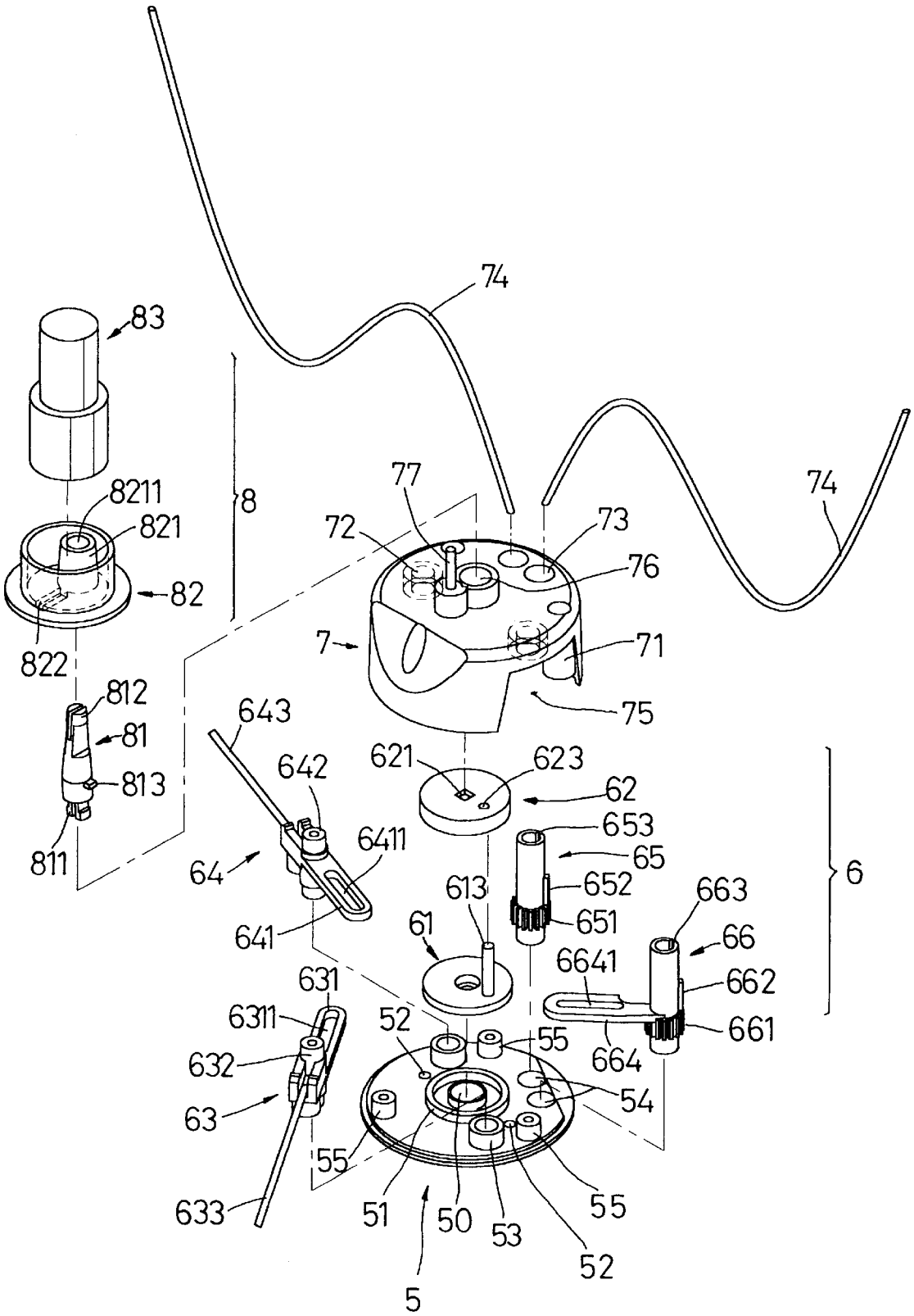
FIG. 6 is an exploded view of the toy structure as shown in FIG. 1.
Figure 7:
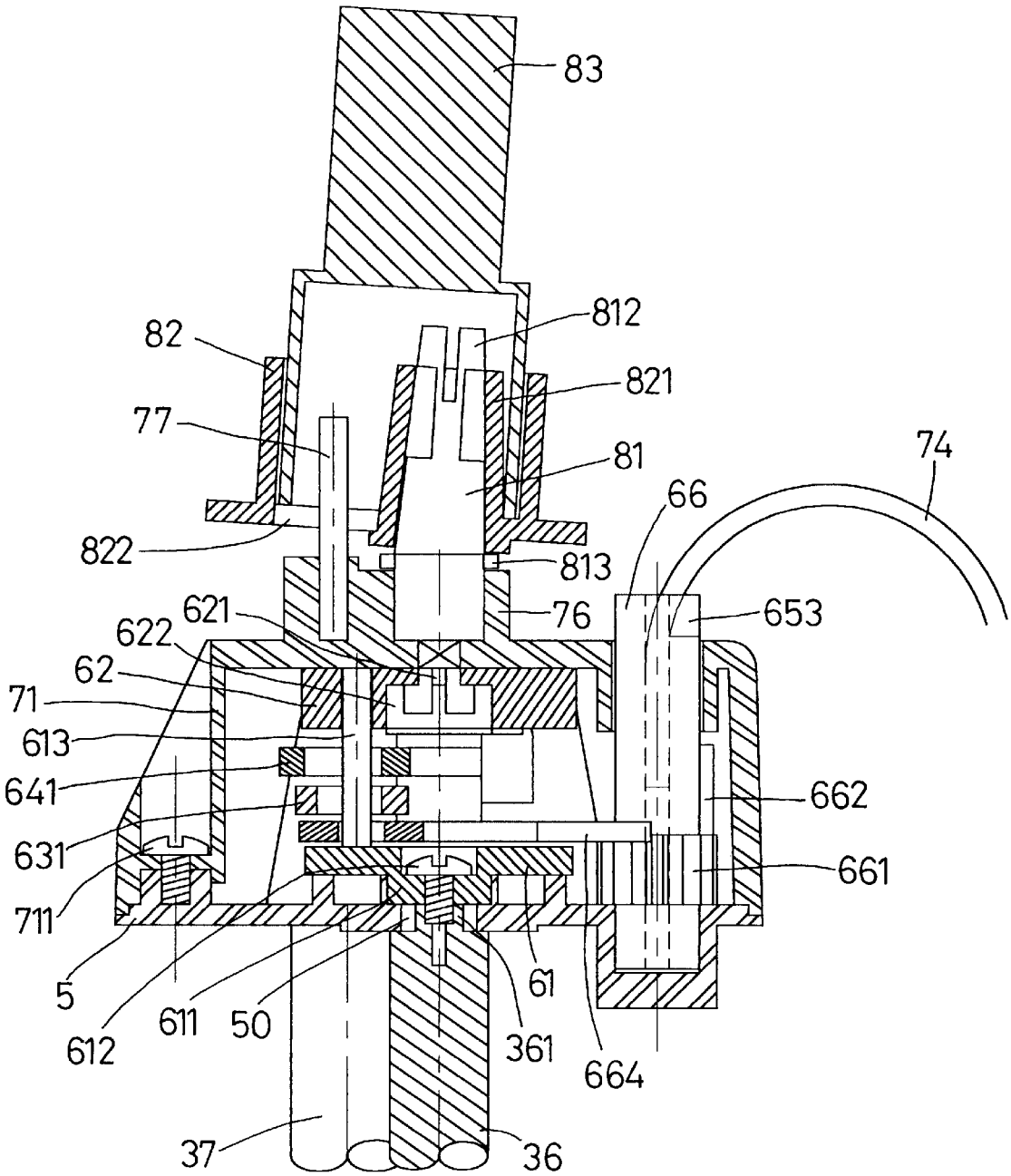
FIG. 7 is a front plan cross-sectional assembly view of the toy structure as shown in FIG. 6.

Referring to FIGS. 6 and 7 with reference to FIG. 3, the support disk 5 is secured on the two support rods 37 and defines a central hole 50 for receiving the drive rod 36.

Each of the two support rods 37 has a threaded bore 371 defined in the top end thereof. The support disk 5 defines two threaded holes 52 each aligning with the threaded bore 371 of a respective one of the support rods 37. Two locking members (not shown) each in turn extend through the threaded hole 52 and the threaded bore 371 for securing the support disk 5 to the two support rods 37.

The swing device 6 is mounted on the support disk 5 and includes an eccentric wheel 61 supported on the support disk 5 and secured to the drive rod 36 to rotate therewith, an eccentric rod 613 secured on the eccentric wheel 61; a first arm skeleton 63 including a first pivot shaft 632 pivotally mounted on the support disk 5, an elongated first follower 631 secured on the first pivot shaft 632 for pivoting the first pivot shaft 632 and defining a first oblong slot 6311 for receiving the eccentric rod 613 to pivot therewith, and a first extension bar 633 secured to the first pivot shaft 632 to pivot therewith; a second arm skeleton 64 including a second pivot shaft 642 pivotally mounted on the support disk 5, an elongated second follower 641 secured on the second pivot shaft 642 for pivoting the second pivot shaft 642 and defining a second oblong slot 6411 for receiving the eccentric rod 613 to pivot therewith, and a second extension bar 643 secured to the second pivot shaft 642 to pivot therewith; a first pivot tube 66 pivotally mounted on the support disk 5 and including an elongated third follower 664 defining a third oblong slot 6641 for receiving the eccentric rod 613 to pivot therewith, and a first gear 661 secured on the first pivot tube 66; and a second pivot tube 65 pivotally mounted on the support disk 5 and including a second gear 651 meshing with the first gear 661 so that the second pivot tube 65 is rotated with the first pivot tube 66.

The shoulder cover 7 includes two wing bars 74 each secured to one of the first pivot tube 66 and the second pivot tube 65 to pivot therewith. The first pivot tube 66 also includes an elongated first rib 662 formed thereon and defines an elongated first slit 663 for securing one of the two wing bars 74, and the second pivot tube 65 also includes an elongated second rib 652 formed thereon and defines an elongated second slit 653 for securing one of the two wing bars 74.

The support disk 5 includes a support ring 51 mounted around the central hole 50. The eccentric wheel 61 is supported on the support ring 51 and includes a block 611 (see FIG. 7) extending downward and received in the central hole 50. The drive rod 36 has an upper end formed with a threaded stub 361 abutting the block 611. The eccentric wheel 61 further includes a locking member 612 (see FIG. 7) extending through the block 611 of the eccentric wheel 61 and screwed into the threaded stub 361 of the drive rod 36 so that the eccentric wheel 61 is secured on the drive rod 36 to rotate therewith.

The support disk 5 includes two coupling tubes 53, and each of the first pivot shaft 632 and the second pivot shaft 642 has a lower end pivotally mounted in one of the two coupling tubes 53. The support disk 5 also defines two coupling sockets 54 for receiving the lower end of each of the first pivot tube 66 and the second pivot tube 65.

The swing device 6 further includes a rotary disk 62 located above the eccentric wheel 61 and defining an insertion hole 623 for receiving the eccentric rod 613 so that the rotary disk 62 is rotated with the eccentric rod 613 of the eccentric wheel 61, a rectangular hole 621 defined in an upper portion of the rotary disk 62, and a recess 622 defined in a lower portion of the rotary disk 62 and connecting to the rectangular hole 621.

The shoulder cover 7 is secured on the support disk 5 and includes an annular neck 76 protruding upward and connecting to an inside of the shoulder cover 7, and a limiting rod 77 protruding upward from the shoulder cover 7.

The support disk 5 includes a plurality of threaded posts 55 each extending upward. Tile shoulder cover 7 includes a plurality of hollow posts 71 each mounted on a respective one of the threaded posts 55, and a plurality of locking members 711 (see FIG. 7) each extending through a respective one of the hollow posts 71 and each screwed into a respective threaded post 55 for securing the shoulder cover 7 to the support disk 5.

The shoulder cover 7 defines two openings 75 for receiving each of the first arm skeleton 63 and tile second arm skeleton 64, and two holes 73 for receiving the upper end of each of the first pivot tube 66 and the second pivot tube 65 as shown in FIG. 7.

The shoulder cover 7 includes two coupling tubes 72 each extending downward. Each of the first pivot shaft 632 and the second pivot shaft 642 has an upper end pivotally mounted in one of the two coupling tubes 72.

The head turning device 8 is mounted on the shoulder cover 7 and includes an inclined rod 81 having a tapered upper portion formed with a first snapper 812, a mediate portion formed with two support lugs 813 abutting the annular neck 76, and a lower portion extending through the annular neck 76 and formed with a second snapper 811 extending through the rectangular hole 621 and snapped into the recess 622 for securing the rotary disk 62 to the shoulder cover 7 so that the inclined rod 81 is rotated with the rotary disk 62, each of the two support lugs 813 having a height different from each other; a doll head turning base 82 including a cone-shaped post 821 mounted on the inclined rod 81 and abutting the two support lugs 813, a cone-shaped hole 8211 defined in the cone-shaped post 821 for receiving the inclined rod 81 with the first snapper 812 protruding outward from the cone-shaped hole 8211, a limiting slot 822 defined in the doll head turning base 82 for receiving the limiting rod 77; and a doll head sleeve 83 mounted on the doll head turning base 82.

Figure 8:
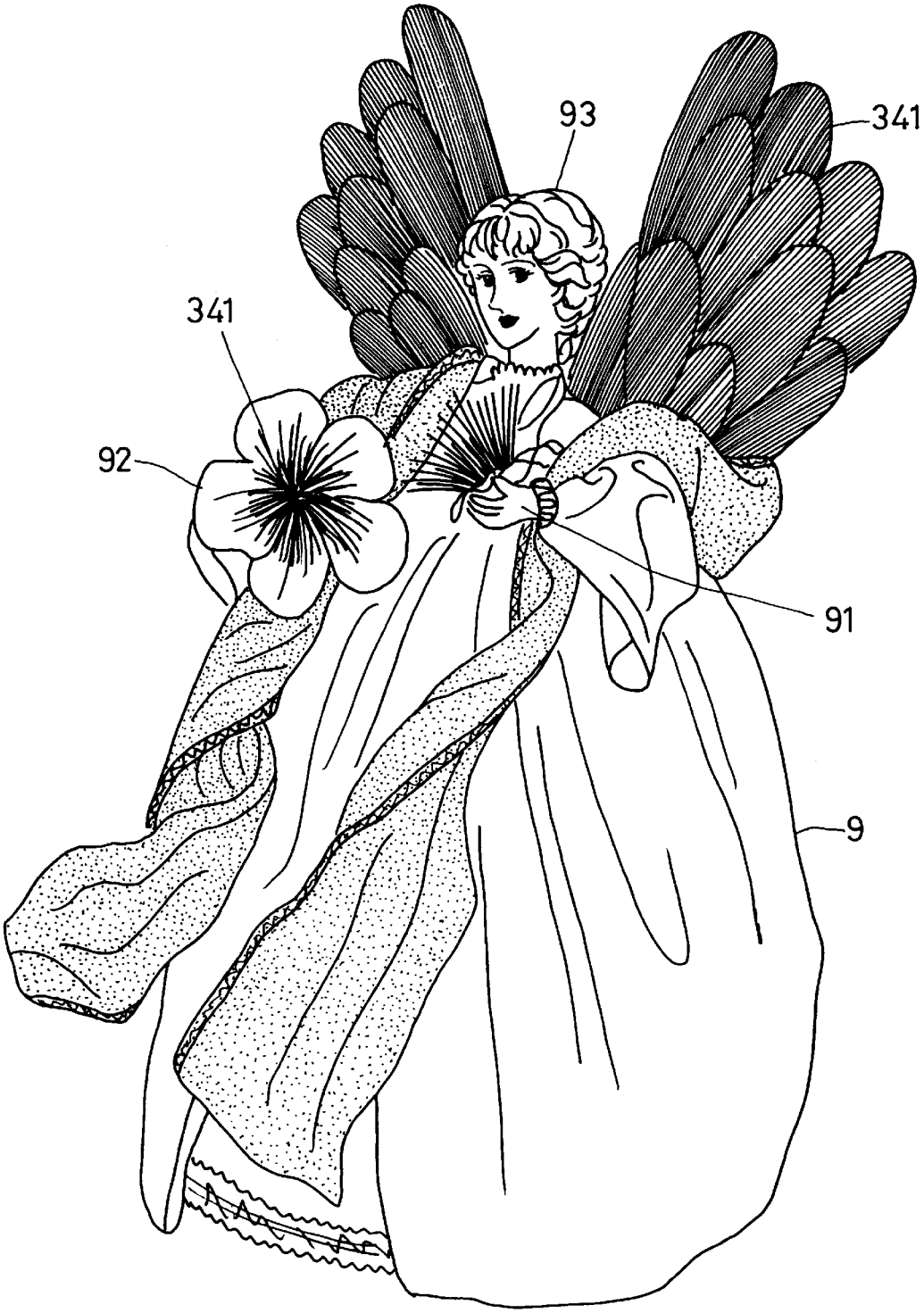
FIG. 8 is a perspective view of the toy structure of a luminous doll type in accordance with an embodiment of the present invention.

Is assembly, referring to FIG. 8 with reference to FIGS. 1–7, the optical fiber 341 received in the receiving chamber 34 of the upper casing 3 is knitted into two wings each secured to a respective wing skeleton 74. Clothes 9 are then put on the toy structure as shown in FIG. 1 with the first extension bar 633 and the second extension bar 643 each extending outward from the clothes 9 to be fitted with a hand 91. A flower-shaped ornament 92 is secured on one of the two hands 91, and a part of the optical fiber 341 passes through the ornament 92. A doll head 93 is then secured on the doll head sleeve 83 of the head turning device 8, thereby completing the assembly of the doll-shaped toy structure.

In operation, referring to FIGS. 7–11 with reference to FIGS. 1–6, the motor 23, the speaker 13 and the projecting lamp 24 are turned on by the switch 33. The color disk 232 is then rotated by the output shaft 231 which is rotated by the motor 23. The rotation of the color disk 232 co-operating with the light emitted from the projecting lamp 24 can present variation of diverse colors which are also projected to the optical fiber 341 which exhibits the variation of colors to surroundings, thereby increasing the aesthetic quality of the ornament 92 and the wings formed by the optical fiber 341.

Figure 9:
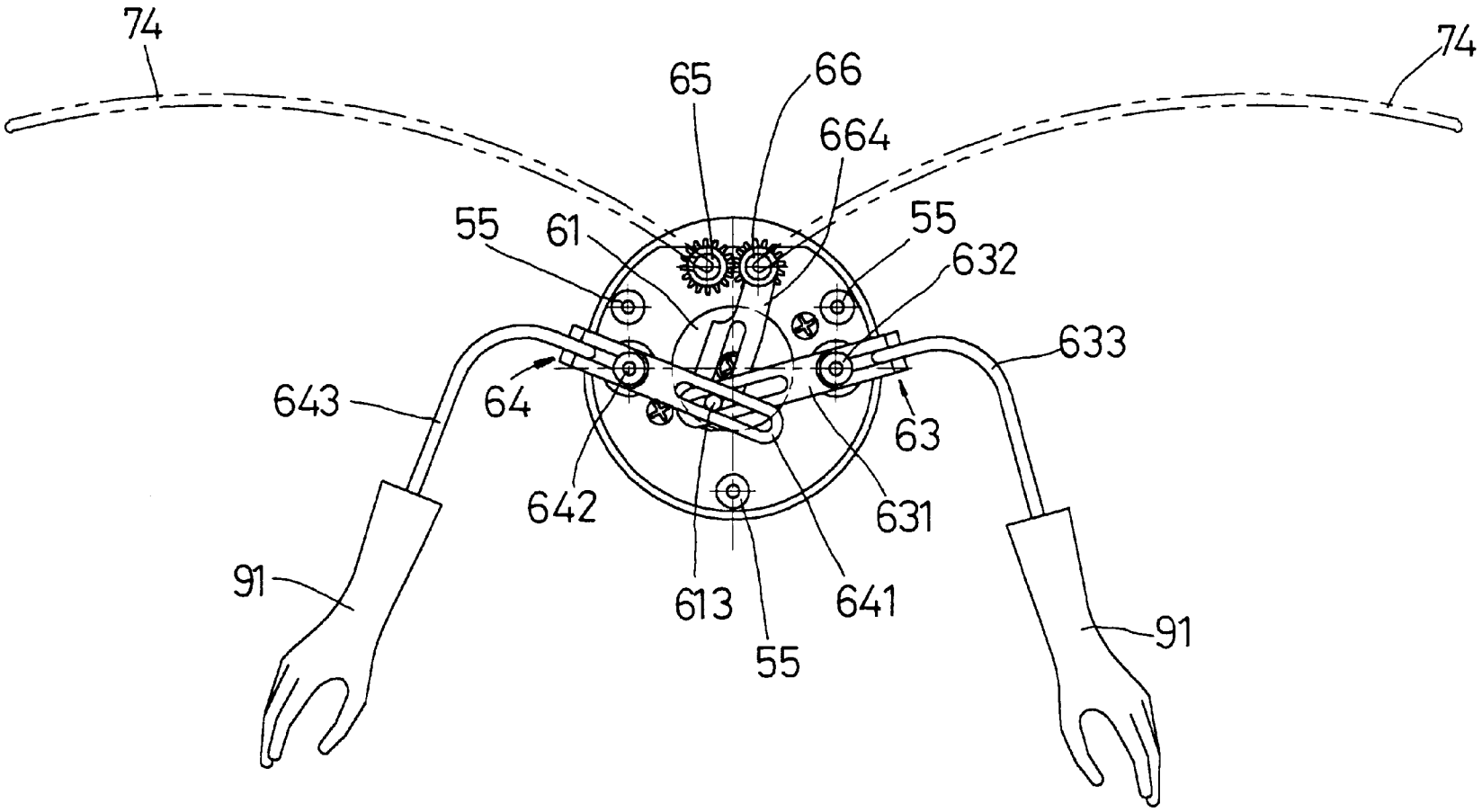
FIG. 9 is a top plan partially cut-away assembly view of the toy structure as shown in FIG. 6.
Figure 10:
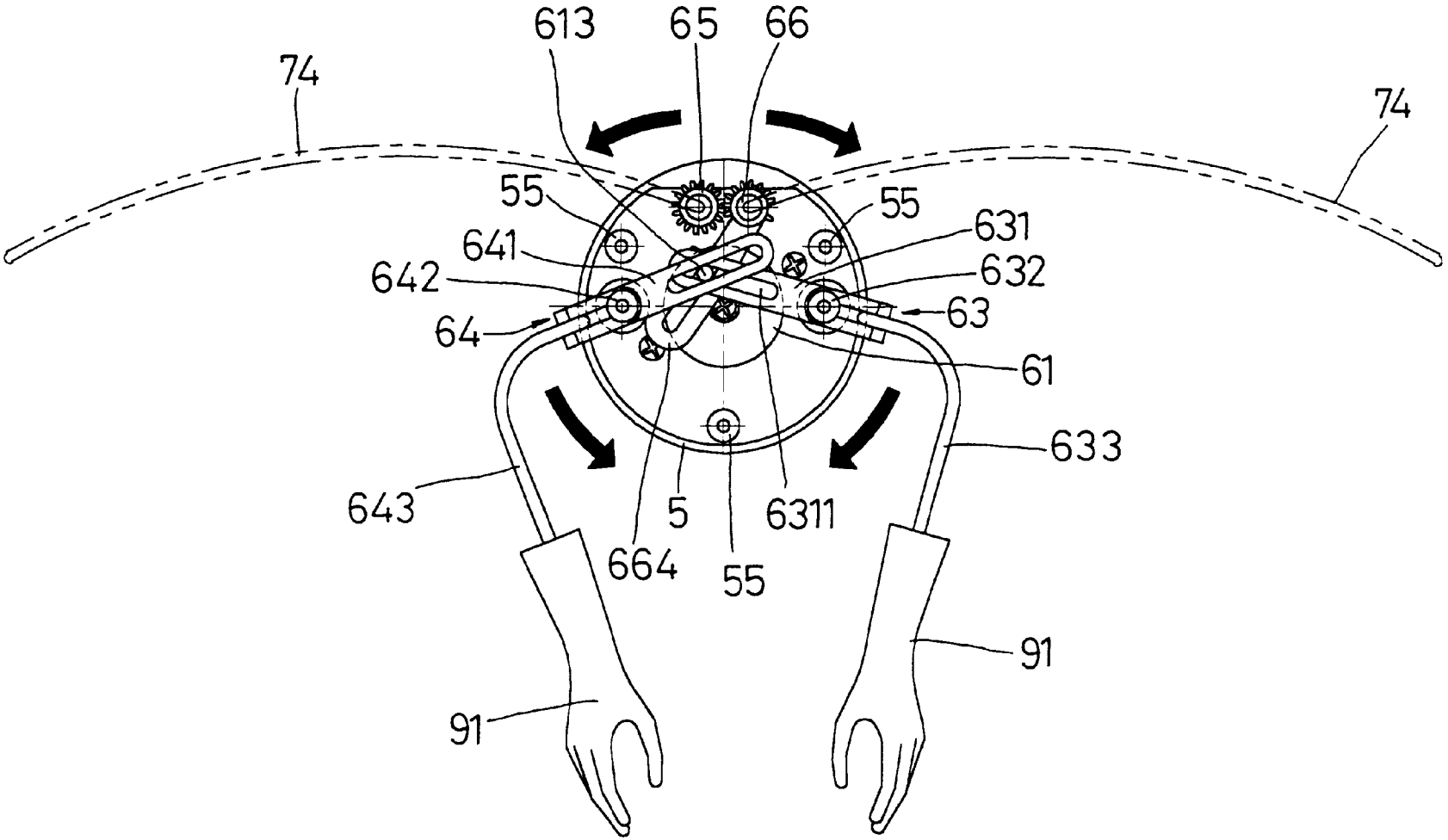
FIG. 10 is an operational view of the toy structure as shown in FIG. 9.
Figure 11:
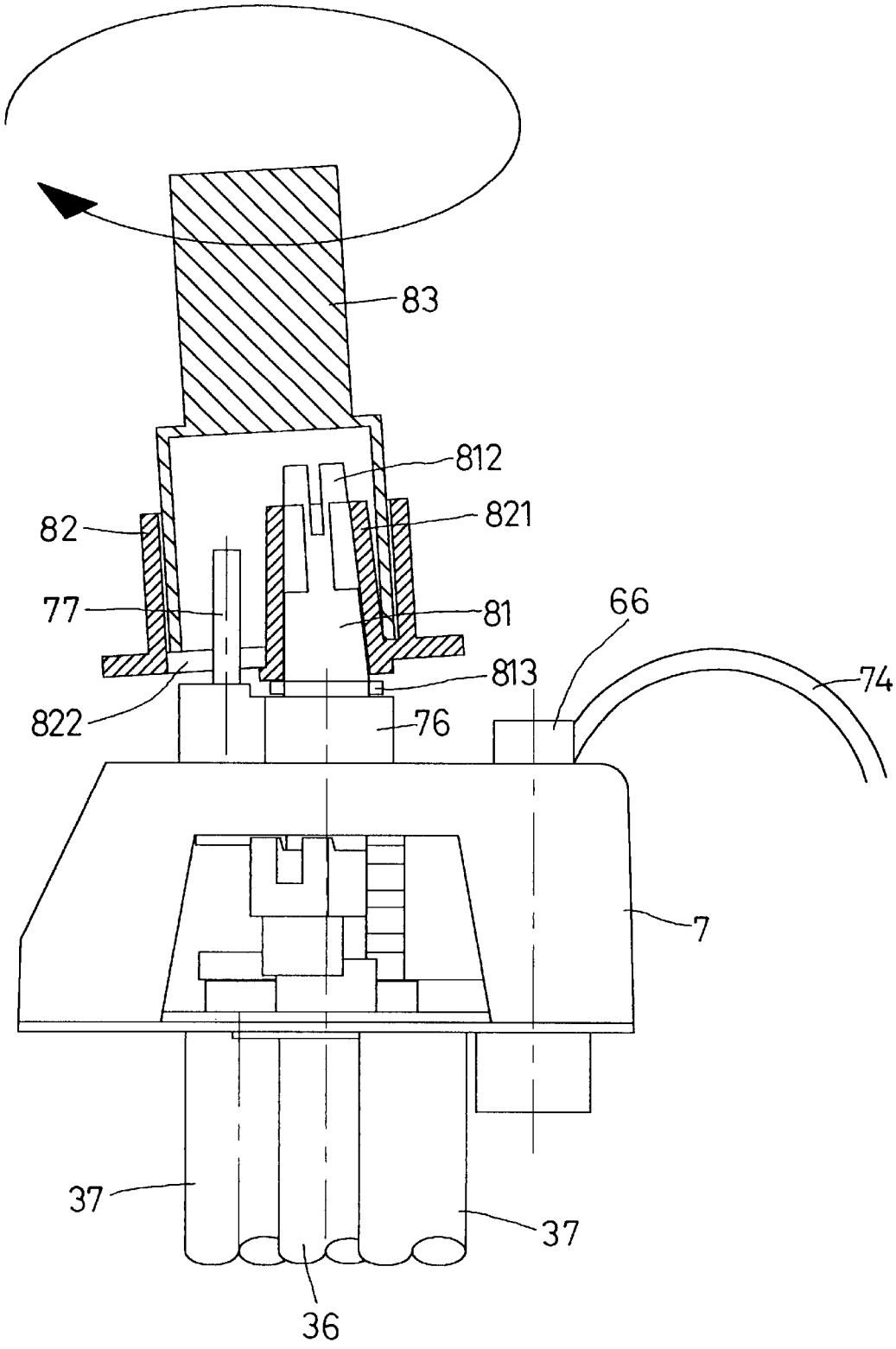
FIG. 11 is an operational view of the toy structure as shown in FIG. 7.

The drive rod 36 is rotated by the rotating ring 233 via the color disk 232 to rotate the eccentric wheel 61 which moves the eccentric rod 613 from the position as shown in FIG. 9 to the position as shown in FIG. 10.

The followers 631 and 641 are moved with the eccentric rod 613 to rotate the pivot shafts 632 and 642 which in turn move the extension bars 633 and 643 so as to move the two hands 91 of the doll from the position as shown in FIG. 9 to the position as shown in FIG. 10, thereby enhancing the true mobility of the doll's hands 91.

The followers 664 is also moved with the eccentric rod 613 to rotate the first pivot tube 66 which in turn rotates the second pivot tube 65 by the first gear 661 meshing with the second gear 651 to move the two wing skeletons 74 from the position as shown in FIG. 9 to the position as shown in FIG. 10, so as to move the doll's two wings 341, thereby enhancing the true mobility of the doll's two wings 341.

At the same time, the rotary disk 62 is rotated by the eccentric wheel 61 to rotate the inclined rod 81 which turns the doll head turning base 82 by the difference of height of the two support lugs 813 on the neck 76 of the shoulder cover 7 (see FIGS. 7 and 11) to turn the doll head sleeve 83 which turns the doll head 93, thereby enhancing the three-dimensional swaying effect and true activity and mobility of the doll's head 93.

It should be clear to those skilled in the art that further embodiments may be made without departing from the scope of the present invention.

What is claimed is:

1. A luminous toy structure comprising:

a base (1);

a lower casing (2) mounted on said base (1);

an upper casing (3) secured on said lower casing (2) and including drive rod (36) rotatably mounted thereon, and two support rods (37) each secured thereon;

a support hood (4) mounted around said base (1), said lower casing (2) and said upper casing (3) for securing said base (1), said lower casing (2) and said upper casing (3) together;

a support disk (5) secured on said two support rods (37) and defining a central hole (50) for receiving said drive rod (36);

a swing device (6) mounted on said support disk (5) and including:

an eccentric wheel (61) supported on said support disk (5) and secured on said drive rod (36) to rotate therewith, an eccentric rod (613) secured on said eccentric wheel (61);

a first arm skeleton (63) including a first pivot shaft (632) pivotally mounted on said support disk (5), a first follower (631) secured on said first pivot shaft (632) for pivoting said first pivot shaft (632) and defining a first oblong slot (6311) for receiving said eccentric rod (613), and a first extension bar (633) secured to said first pivot shaft (632) to pivot therewith;

a second arm skeleton (64) including a second pivot shaft (642) pivotally mounted on said support disk (5), a second follower (641) secured on said second pivot shaft (642) for pivoting said second pivot shaft (642) and fining a second oblong slot (6411) for receiving said eccentric rod (613), and second extension bar (643) secured to said second pivot shaft (642) to pivot therewith;

a first pivot tube (66) pivotally mounted on said support disk 5) and including a third follower (664) defining a third oblong slot (6641) for receiving said eccentric rod (613), and a first gear (661) secured thereon; and a second pivot tube (65) pivotally mounted on said support disk (5) and including a second gear (651) meshing with said first gear (661); and two wing bars (74) each secured to one of said first pivot tube (66) and said second pivot tube (65) to pivot therewith.

2. The luminous toy structure in accordance with claim 1, wherein said support hood (4) defines a plurality of retaining holes (42), and has a top portion formed with a reduced section (41) defining an opening (411), said base (1) defines a receiving chamber (12) and includes an annular flange (11) having a plurality of first tongues (111) protruding outward each secured in a respective one of said retaining holes (42), and a speaker (13) mounted in said receiving chamber (12), said lower casing (2) includes a plurality of first threaded posts (25), and said upper casing (3) defines a central hole (35) for passage of said drive rod (36) and includes a plurality of second tongues (32) protruding outward each secured in a respective one of said retaining holes (42), a switch (33) secured on said upper casing (3), a receiving tube (34) secured on said upper casing (3), a bundle of optical fiber (341) mounted in said receiving tube (34), and a plurality of second threaded posts (31) each engaged with a respective one of said first threaded posts (25).

3. The luminous toy structure in accordance with claim 1, wherein said lower casing (2) includes a hollow post (22) extending downward, a motor (23) mounted in said lower casing (2), an output shaft (231) having a lower end secured on said motor (23) to be rotated by said motor (23), a color disk (232) secured on an upper end of said output shaft (231) to rotate therewith, a rotating ring (233) secured on said color disk (232) to rotate therewith, a plurality of bosses (2331) mounted in said rotating ring (233), a projecting lamp (24) mounted in said lower casing (2) and directed toward said color disk (232), and said drive rod (36) has a lower end formed with a follower wheel (362) secured in said rotating ring (233) to rotate therewith and defining a plurality of dents (3621) each receiving a corresponding one of said bosses (2331).

4. The luminous toy structure in accordance with claim 1, wherein said support disk (5) includes a support ring (51) mounted around said central hole (50), said eccentric wheel (61) is supported on said support ring (51) and includes a block (611) extending downward and received in said central hole (50), said drive rod (36) has an upper end formed with a threaded stub (361) abutting said block (611), and said eccentric wheel (61) further includes a locking member (612) extending through said block (611) and screwed into said threaded stub (361) of said drive rod (36).

5. The luminous toy structure in accordance with claim 1, wherein said support disk (5) includes two coupling tubes (53), and each of said first pivot shaft (632) and said second pivot shaft (642) has a lower end pivotally mounted in one of said two coupling tubes (53).

6. The luminous toy structure in accordance with claim 1, wherein said support disk (5) defines two coupling sockets (54) for receiving each of said first pivot tube (66) and said second pivot tube (65).

7. The luminous toy structure in accordance with claim 1, wherein said first pivot tube (66) includes an elongated first rib (662) formed thereon and defines an elongated first slit (663) for securing one of said two wing bars (74), and said second pivot tube (65) includes an elongated second rib (652) formed thereon and defines an elongated second slit (653) for securing one of said two wing bars (74).

8. The luminous toy structure in accordance with claim 1, wherein said swing device (6) further includes a rotary disk (62) located above said eccentric wheel (61) and defining an insertion hole (623) for receiving said eccentric rod (613), a rectangular hole (621) defined in an upper portion of said rotary disk (62), a recess (622) defined in a lower portion of said rotary disk (62) and connecting to said rectangular hole (621), and said luminous toy structure further comprises:

a shoulder cover (7) secured on said support disk (5) and including an annular neck (76) protruding upward and connecting to an inside of said shoulder cover (7), and a limiting rod (77) protruding upward; and a head turning device (8) mounted on said shoulder cover (7) and including:

an inclined rod (81) having an upper portion formed with a first snapper (812), a mediate portion formed with two support lugs (813) abutting said annular neck (76), and a lower portion extending through said annular neck (76) and formed with a second snapper (811) extending through said rectangular hole (621) and snapped into said recess (622) for securing said rotary disk (62) to said shoulder cover (7), each of said two support lugs (813) having a height different from each other;

a doll head turning base (82) including a cone-shaped post (821) mounted on said inclined rod (81) and abutting said two support lugs (813), a cone-shaped hole (8211) defined in said cone-shaped post (821) for receiving said inclined rod (81) with said first snapper (812) protruding outward from said cone-shaped hole (8211), and a limiting slot (822) defined in said doll head turning base (82) for receiving said limiting rod (77); and a doll head sleeve (83) mounted on said doll head turning base is (82).

9. The luminous toy structure in accordance with claim 8, wherein said shoulder cover (7) defines two holes (73) for receiving each of said first pivot tube (66) and said second pivot tube (65).

10. The luminous toy structure in accordance with claim 8, wherein said shoulder cover (7) includes two coupling tubes (72) extending downward, and each of said first pivot shaft (632) and said second pivot shaft (642) has an upper end pivotally mounted in one of said two coupling tubes (72).

11. The luminous toy structure in accordance with claim 8, wherein said shoulder cover (7) defines two openings (75) for receiving each of said first arm skeleton (63) and said second arm skeleton (64).

* * * * *